United States Patent [19]

Rodermund et al.

[11] 3,942,310

[45] Mar. 9, 1976

[54] MACHINE FOR MANUFACTURING GARLANDS

[75] Inventors: Gerd Rodermund; Helmut Kappus, both of Lahr, Germany

[73] Assignee: Gerd Rodermund, Lahr, Germany

[22] Filed: Mar. 20, 1974

[21] Appl. No.: 452,797

[30] Foreign Application Priority Data

Nov. 7, 1973 Germany ..... 7339710

[52] U.S. Cl. ..... 57/24

[51] Int. Cl.[2]... D04D 1/02; D04D 3/00; D02G 3/42

[58] Field of Search..... 57/24, 156, 143

[56] References Cited

UNITED STATES PATENTS 3,330,103 7/1967 Rodermund et al. ..... 57/24

*Primary Examiner*—John Petrakes

*Attorney, Agent, or Firm*—Barnes, Kisselle, Raisch & Choate

[57] ABSTRACT

A machine for manufacturing garlands comprising a device for producing a tube from filament-like or strip-like material on two conveyor screws arranged at a distance from one another, which are mounted on one side, driven at the same speed in opposite directions, and have opposite threads by using two parallel pairs of threads, each of said pairs of threads consisting of a core wire or thread extending through a longitudinal bore of said conveyor screws, and an outer wire or thread, and means for twisting said pairs of wire or thread around sections of said winding material, said sections being formed by severing said tube, and with means for drawing off the pairs of wire or thread. The conveyor screws are located at two corners of an imaginary polygon which is symmetrical around the center of the line connecting said corners. Additional conveyor screws are arranged at the remaining corners of said polygon driven at the same speed, so that the number of conveyor screws having one direction of rotation is equal to the number of conveyor screws having an opposite direction of rotation. A cutting device is arranged at each side of the intersecting lines for centrally severing the corresponding half of the tube.

5 Claims, 3 Drawing Figures

MACHINE FOR THE MANUFACTURING GARLANDS

The invention relates to a machine for manufacturing garlands which comprises a device for producing a tube from filamentary or band-shaped winding material on two conveyor screws arranged at a distance from one another which are mounted on one side, are driven at the same speed in opposite directions, and which have opposite threads, using two parallel pairs of wire or thread, each pair consisting of a core wire or thread extending through a longitudinal bore of the conveyor screws, and an outer wire or thread, and an apparatus for twisting the wires or threads around sections of the winding material which are formed by severing open the tube, and with an apparatus for drawing off the pairs of wires or threads.

Known machines of this type (German patent No. 1,435,244 corresponding to U.S. Pat. No. 3,330,103) have the advantage that the winding material is positively advanced by the conveyor screws onto the core wires and delivered to the cutting device, and the conveyor screws take up the winding tension. This means that as a winding material not only very thin silk threads but also coarser or very smooth winding material can be used and garlands manufactured which have a relatively thick diameter. Winding the material on the two conveyor screws which results in the formation of a flat tube presents some difficulties with such winding material, since its stiffness or lack of toughness makes it hard to wind on the conveyor screws with a small radius of curvature. In addition, the discontinuous advance of the winding material limits the work speed.

The object of the invention is to improve known machines so as to be able to use very stiff and very fragile winding material, and to increase the work speed. For solving this problem, the invention starts from a machine of the type set forth above and is characterized in that the conveyor screws are located at two corners of an imaginary polygon which is symmetrical about the center of the line connecting said corners, that at the remaining corners of the polygon there are additional conveyor screws driven at the same speed so that the number of conveyor screws having the same direction of rotation is equal to the number of conveyor screws having the opposite direction of rotation, and that at both sides of the intersecting lines there is arranged a cutting device for severing each half of the tube at the center.

In that way, it is not a flat tube which is formed from the winding material but by means of the additional conveyor screws the tube has a polygonal section and is thus near the theoretical ideal of a circular section. Hence the winding material may be wound more uniformly and at a wider radius of curvature, so that for instance finished garlands can be used as a winding material for a garland of a higher order. The advantages of known machines, that is, positively forwarding the tube on the core wires and feeding it to the cutting device, is maintained. Severing is facilitated in addition by each cutting device only severing one wall of the tube.

The definition of polygons whose corners are symmetrical around a definite point of reference comprises a multitude of polygons with an even number of corners. The best arrangement with regard to a maximum approximation to a circular section on the one hand, and to design requirements on the other hand is obtained if the conveyor screws are located at the corners of a regular hexagon. In this case, it is advantageous that the conveyor screws having core wire bores and the two associated conveyor screws have the same direction of rotation and the same thread.

The diameter of the finished garlands is determined by the circumference of the wound tube. Hence, it is a further object of the invention to mount the conveyor screws on a common base which is attached to the machine so as to be easily removed. For manufacturing garlands of different diameter thus different base plates can be used on which the conveyor screws are arranged at a corresponding distance. The conveyor screws are advantageously driven by means of chains, in a way that the conveyor screws having the same direction of rotation are driven by a chain which runs on the sprocket of a drive shaft and on the sprockets of the conveyor screws. The sprockets can be arranged on the rear side of the interchangeable base and can be covered so as to exclude any troubles.

With these and other objects in view which will become apparent in the following detailed description, the present invention will be clearly understood in connection with the accompanying drawings, wherein.

Figure 1:
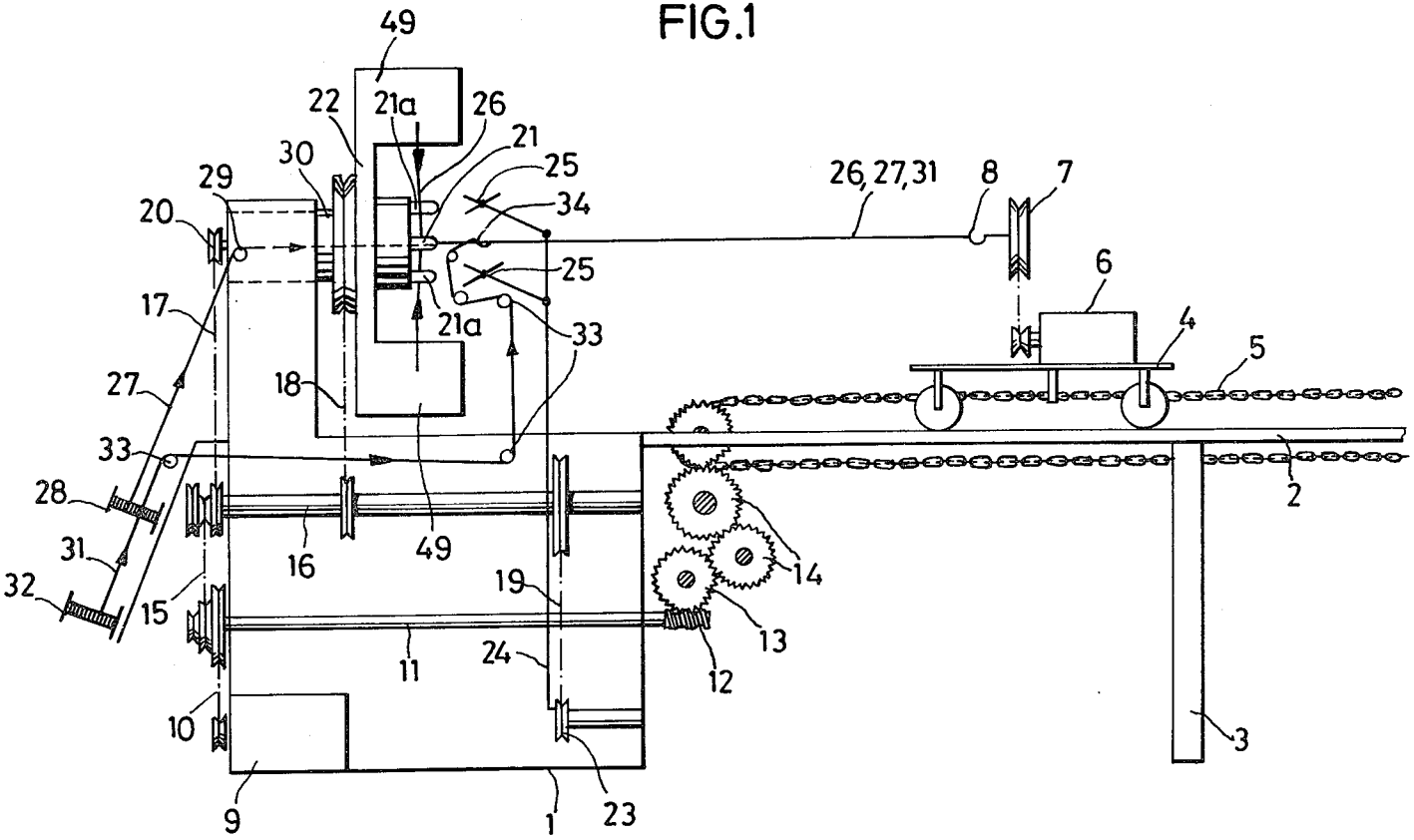
FIG. 1 is a side elevation of a machine designed in accordance with the invention.

Referring now to the drawings and in particular to FIG. 1, a frame 1 which may consist, for example, of profiled bars, receives the individual component parts of the machine. Extending from the frame is a draw-off track 2 with supports 3. A carriage 4 operated, for example, by a chain 5 runs on the draw-off track 2. Arranged on the carriage 4 is a motor 6 supplied by means of a flexible lead (not shown). The motor drives twisting heads 8 by way of a belt drive 7, the transmission ratio of which is gradually adjustable by changing the pulley diameter. For example, simple hooks to which the core wires and outer wires are attached can be used.

A motor 9 is arranged in frame 1, which drives an intermediate shaft 11 by way of a belt drive 10. The other end of the intermediate shaft drives through a worm and a worm wheel 13 and an intermediate gear 14 and chain 5 for the draw-off movement of the carriage 4. Another belt drive 15, having stepwise variable transmission ratio, leads from the intermediate shaft 11 to a second intermediate shaft 16. This last-mentioned shaft drives by way of the belt drives 17, 18 and 19 a belt pulley 20 for the power transmission to the conveyor screws 21, a winding frame 22 and an eccentric wheel 23. A steel wire 24 leads from the eccentric wheel to scissors 25 which sever the tube consisting of winding material 26. Scissors 25 are opened by means of suitable springs.

The core wires or threads 27 are withdrawn from spools 28, run over guide rollers 29 through a bearing tube 30 of the winding frame 22, and then pass through the conveyor screws 21 to the twisting heads 8. The outer wires 31 run over suitably arranged guide rollers 33 to the core wires 27 and are twisted with them at 34.

Figure 2:
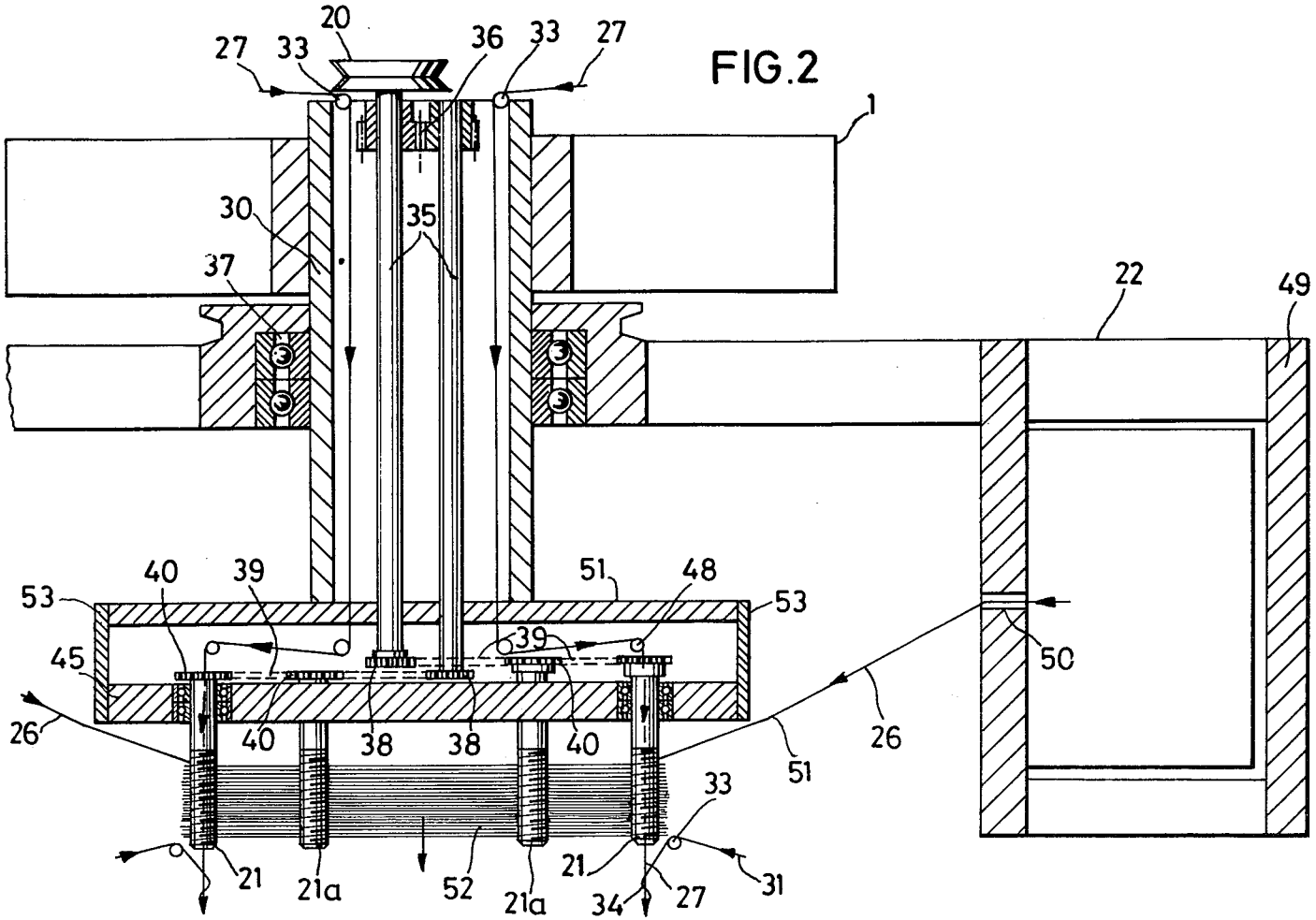
FIG. 2 is a sectional view of the machine according to FIG. 1.
Figure 3:
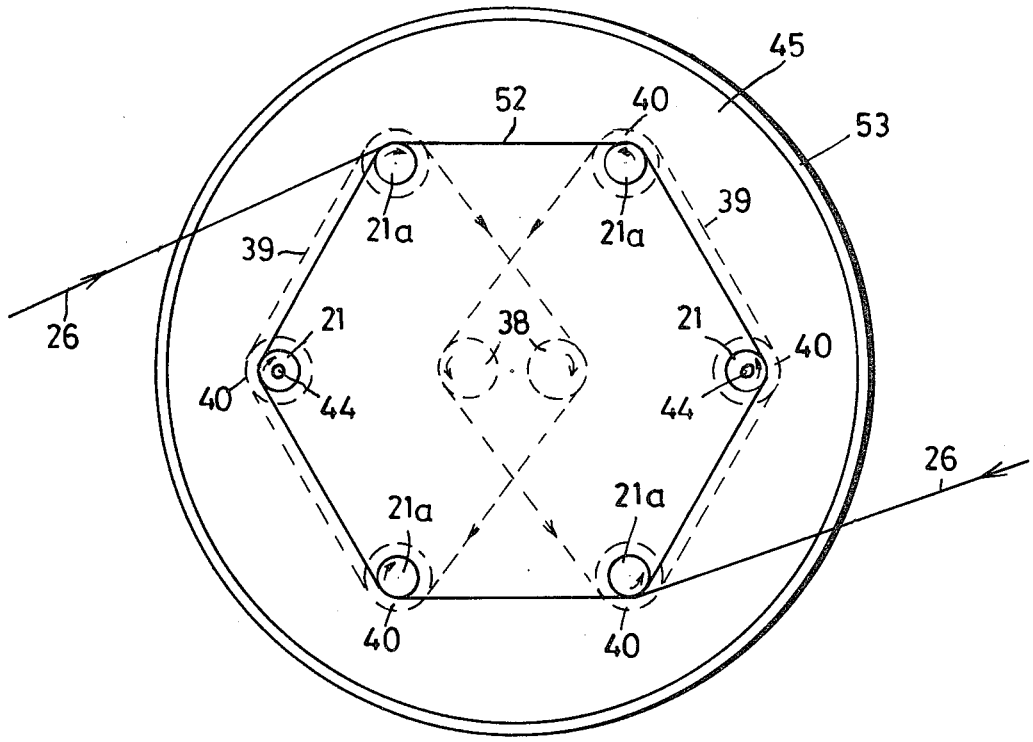
FIG. 3 is a partial front view of the machine according to FIGS. 1 and 2.

Referring now again to the drawing and in particular to FIG. 3 which is a front view of the machine, and to FIG. 2 which is a sectional view, there are arranged on a plate 45, in addition to the two conveyor screws 21 through whose longitudinal bores 44 run the core wires 27, two each additional conveyor screws 21*a* at top and bottom in a way that all the conveyor screws together form the corners of a regular hexagon.

The conveyor screws 21, 21*a* are driven by means of two shafts 35. One shaft is driven by the belt pulley and turns the other shaft in the opposite direction by way of gear train 36. The shafts 35 extend through the bearing tube 30 for the winding frame 22 which is mounted on the tube 30 by means of a ball bearing 37. Mounted on the shafts at the front end thereof with respect to the drawing-off direction are sprocket wheels 38 which drive the sprocket wheels 40 of the conveyor screws 21, 21*a* by means of chains 39 (cp. FIG. 3). The total drive of the conveyor screws 21, 21*a* mounted on the rear side of plate 45 and consisting of sprockets 38, 40 and chains 39 is covered by a cover plate and a circumferential wall 53.

The total unit consisting of both plates 45, 51, of the conveyor screws and their drive, as well as of circumferential wall 53 is attached to the bearing tube 30 in a way as to be easily removable (not shown). Thus, the total unit can be replaced by another unit which is equally provided with 6 conveyor screws but which have a bigger or smaller distance from one another, for manufacturing garlands having a bigger or smaller diameter.

The winding material 26 is fed from supply spools or rolls arranged in cages 49 of the winding frame 22. Disposed at the supply opening 50 is a suitable braking device (not shown) which permits any desired tension of the winding material 26. After the winding material has left the braking device, it is wound on the conveyor screws 21, 21*a* to form a tube 52 which has a regular hexagonal section in accordance with the arrangement of the conveyor screws.

The conveyor screws 21, 21*a* cause the tube 52 to positively move off the screws onto the two scissors 25 (FIG. 1). Owing to three conveyor screws having one direction of rotation, and three conveyor screws having another direction of rotation, it is ensured that tube 52 does not take part in the rotary movement of the screws. After severing the tube between the two top conveyor screws 21, and the two bottom conveyor screws 21*a*, the fibers thus formed and consisting of the winding material 26 are bound in between the core wires and outer wires 27 and 31 respectively, and are secured in this position by twisting.

The core and outer wires or threads can be selected according to the winding material employed and the desired form and strength of the garlands. It may be expedient that they consist in each case of a plurality of wires or threads, or of combinations of the two. In particular, plastic filaments or combinations thereof with metallic wires may also be especially advantageous.

As has already been explained, the winding material 26 may consist of any desired filaments and in fact also of stiff and smooth filaments. Garlands of a smaller diameter formed in a first operation or by a different procedure may also be used as a winding material. It is not necessary for the two filaments wound on the conveyor screws to be of the same material. Winding frame 22 may in addition be provided with more than two cages 49.

We claim:

1. A machine for manufacturing garlands comprising a plurality of conveyor screws arranged at a distance from one another at the corners of an imaginary polygon which is symmetrical around the center of a line connecting two opposite corners, two of said conveyor screws which are opposite one another having longitudinal bores through which core wires are drawn, means for driving said screws at the same speed, alternate screws having a thread thereon extending in the same direction, alternate screws being driven in a direction opposite screws adjacent thereto, means for supply of winding material to the periphery of conveyor screws to form a tube as the screws rotate, means for cutting said tube at opposite sides thereof to form severed portions of said tube, means for supplying outer wires, means for twisting each said core wire, its respective outer wires and its respective severed portion of said tube together.

2. A machine according to claim 1, characterized in that the conveyor screws are located at the corners of a regular hexagon.

3. A machine according to claim 1, characterized in that the conveyor screws are mounted on a common base which can be easily removed from the machine and replaced with a base having screws thereon at different distances from one another.

4. A machine according to claim 3, characterized in that the conveyor screws having the same direction of rotation are driven by a drive shaft, a sprocket on said drive shaft, sprockets on said conveyor screws, and a chain trained over said sprockets, and on the sprockets of the conveyor screws.

5. A machine according to claim 4, characterized in that said sprockets are mounted on the rear side of the base and covered by a covering plate.

* * * * *